United States Patent [19]

Hellein

[11] Patent Number: 4,984,592

[45] Date of Patent: Jan. 15, 1991

[54] MANICURE SHIELD

[76] Inventor: Christine Hellein, R.D. 1, Box 136C, Hopwood, Pa. 15445

[21] Appl. No.: 451,644

[22] Filed: Dec. 18, 1989

[51] Int. Cl.[5] ..... A45D 29/00

[52] U.S. Cl. ..... 132/285; 132/73; 2/21

[58] Field of Search ..... 132/73, 285, 319; 2/21

[56] References Cited

U.S. PATENT DOCUMENTS

| | | | |
|---|---|---|---|
| D. 136,030 | 7/1943 | Belmonte et al. | 132/73 |
| 203,978 | 5/1878 | Woods | 2/21 |
| 2,179,046 | 11/1939 | Lewis | 132/73 |
| 2,487,101 | 11/1949 | Colby et al. | 2/21 |
| 2,546,619 | 3/1957 | Turner | 2/21 |
| 2,799,282 | 7/1957 | Slack | 132/285 |
| 3,198,197 | 8/1965 | Van Halanger | 132/73 |
| 3,228,404 | 1/1966 | Turner | 132/73 |
| 3,967,631 | 7/1976 | Koasal | 132/73 |
| 3,972,325 | 8/1976 | Bluestone | 132/73 |
| 4,089,066 | 5/1978 | Dethman | 2/21 |
| 4,694,843 | 9/1987 | Casenhiser | 132/73 |

FOREIGN PATENT DOCUMENTS

| | | | |
|---|---|---|---|
| 978211 | 4/1951 | France | 132/319 |

*Primary Examiner*—John J. Wilson
*Assistant Examiner*—F. LaViola, Jr.
*Attorney, Agent, or Firm*—Leon Gilden

[57] ABSTRACT

A manicure shield is set forth provided with an elongate convex shield to overlie a fingernail to prevent inadvertent contact with a nail and a foreign object during a drying procedure subsequent to the applying of a liquid convering and the like. The shield is formed with a plurality of parallel downwardly depending legs pivotally mounted to an upper, relatively rigid polymeric ring integrally secured to a lower resilient recircling ring for securement about a finger adjacent an associated fingernail of an individual. The lower ring may alternatively be defined by a pair of resiliently biased legs for securement to an individual's finger. A flexible tab secured to an upper surface of the upper ring is in contact with the rear convex surface of the shield to maintain the shield in an upper or lowered position.

1 Claim, 1 Drawing Sheet

Fig 1
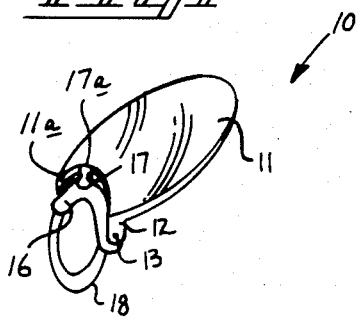
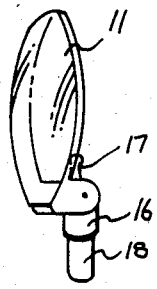
Fig 2A
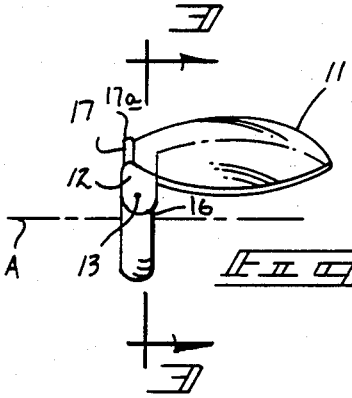
Fig 2
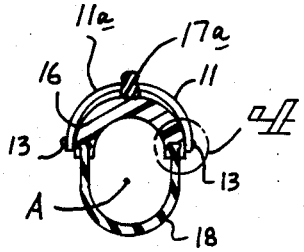
Fig 3
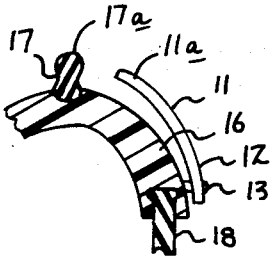
Fig 4
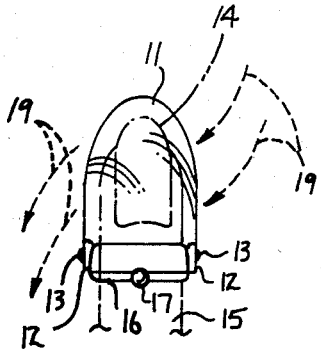
Fig 5
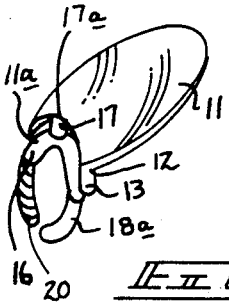
Fig 6

MANICURE SHIELD

BACKGROUND OF THE INVENTION

1. Field of the Invention

The field of invention relates to manicure shields, and more particularly pertains to a new and improved manicure shield which may be pivotally lowered to protect a manicured nail, or selectively raised to allow access to the nail.

2. Description of the Prior Art

Various coverings to provide protection for manicured nails have been developed in the prior art. Previously, however, the prior art organizations have not completely availed themselves to enable selective access to the fingernail when desired, and to thereafter overlie the nail to protect the same during a curing or drying of various coatings applied to a fingernail during a manicuring procedure. For example, U.S. Pat. No. 3,198,197 to Halanger sets forth a manicure nail protector wherein the glove-like portion developed by the patent to Halanger utilizes removable finger partitions to enable access to the nail, but is of a relatively expansive and awkward organization, as opposed to that of the instant invention.

U.S. Pat. No. 3,228,404 to Turner sets forth a nail protecting and lengthening procedure wherein an overlay of a relatively elongate convex configuration is applied to an existing nail to protect and lengthen an existing fingernail.

U.S. Pat. No. 3,967,631 to Kosal sets forth a series of fingernail caps securable about an existing fingernail to protect the fingernail from dirt, breaking, cracking and the like for use by women utilize lengthened fingernails during physical activity.

U.S. Pat. No. 3,972,325 to Bluestone sets forth a manner of protecting a long, protruding fingernail during performance of a manual activity by adhesively securing a cushioning member to an undersurface of an existing fingernail.

U.S. Pat. No. 4,694,843 to Casenhiser sets forth a tubular finger end sheath with a cavity for receiving a fingernail therein to protect an existing fingernail during manual activity and the like.

As such, it may be appreciated that there is a continuing need for a new and improved manicure shield which addresses both the problems of ease of use and effectiveness in construction, and in this respect, the present invention substantially fulfills this need.

SUMMARY OF THE INVENTION

In view of the foregoing disadvantages inherent in the known types of manicure shields now present in the prior art, the present invention provides a manicure shield wherein the same utilizes a selectively securable ring with a pivoted, elongate convex shield to selectively protect or provide access to a fingernail during a manicuring procedure. As such, the general purpose of the present invention, which will be described subsequently in greater detail, is to provide a new and improved manicure shield which has all the advantages of the prior art manicure shields and none of the disadvantages.

To attain this, the present invention comprises a manicure shield wherein the same utilizes an elongate, transparent, convex shield with downwardly depending parallel legs integrally formed at rear side portions of the shield and pivotally mounted to an upper rigid polymeric ring with an underlying integrally secured resilient ring to enable attachment of the shield adjacent an existing fingernail. An upwardly extending tab spaced a distance equal to or slightly greater than the predetermined height of the upper surface of the shield cooperates with a rear convex end surface of the shield to maintain the shield in a lowered position, or when pivoted upwardly, the tab cooperates with a bottom surface of the shield to maintain the shield in a raised orientation.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limited as to the scope of the invention in any way.

It is therefore an object of the present invention to provide a new and improved manicure shield which has all the advantages of the prior art manicure shields and none of the disadvantages.

It is another object of the present invention to provide a new and improved manicure shield which may be easily and efficiently manufactured and marketed.

It is a further object of the present invention to provide a new and improved manicure shield which is of a durable and reliable construction.

An even further object of the present invention is to provide a new and improved manicure shield which is susceptible of a low cost of manufacture with regard to both materials and labor, and which accordingly is then susceptible of low prices of sale to the consuming public, thereby making such manicure shields economically available to the buying public.

Still yet another object of the present invention is to provide a new and improved manicure shield which provides in the apparatuses and methods of the prior art some of the advantages thereof, while simultaneously overcoming some of the disadvantages normally associated therewith.

Still another object of the present invention is to provide a new and improved manicure shield wherein the same is attached to an individual finger adjacent a fingernail to provide selective covering and access to that fingernail.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an orthographic view taken in elevation of the instant invention in a lowered position.

FIG. 2*a* is an orthographic view taken in elevation of the instant invention in a raised position.

FIG. 3 is an orthographic view taken along the lines 3—3 of FIG. 2 in the direction indicated by the arrows.

FIG. 4 is an enlarged view of the section 4 of FIG. 3.

FIG. 5 is an orthographic top view of the instant invention secured to an associated finger adjacent a fingernail.

FIG. 6 is an isometric illustration of the instant invention employing modified finger securement means.

DESCRIPTION OF THE PREFERRED EMBODIMENT

With reference now to the drawings, and in particular to FIGS. 1 to 5 thereof, a new and improved manicure shield embodying the principles and concepts of the present invention and generally designated by the reference numeral 10 will be described.

More specifically, the manicure shield apparatus 10 of the instant invention essentially comprises an elongate, convex, transparent shield 11 defining a cross-sectional arc of less than 180 degrees with a pair of downwardly depending parallel legs 12 integrally formed to rearwardmost side portions of the shield 11. The shield 11 further is defined by a rear convex arcuate surface 11*a* oriented generally orthogonally to the upper and lower surfaces of the shield 11. A pivot axle 13 is directed through each of the legs 12 and are each aligned relative to one another and integrally secured orthogonally to an upper rigid polymeric semi-circular ring 16 adapted to overlie an upper surface of an associated finger 15 adjacent an associated fingernail 14. A flexible tab 17 formed with an upper edge 17*a* extends at a predetermined height equal to or slightly greater than the upper edge defined by the rear convex arcuate surface 11*a*. In this manner, as illustrated in FIG. 2 for example, the shield 11 in a lowered position maintains abutment with the tab 17 against the rear convex arcuate surface 11*a* whereupon raising of the shield to an upper or second position, as illustrated in FIG. 2*a*, positions the tab 17*a* in abutment with an underlying or bottom surface of the shield 11 to maintain the shield in the raised position, as illustrated in FIG. 2*a*. The flexible tab 17 therefore enables access to the fingernail 14 during a manicuring procedure and maintains the shield in that raised position, whereupon lowering of the shield 11 to the position, as illustrated in FIG. 2, maintains the shield at an orientation spaced above the fingernail 14 to protect the nail during a drying procedure of various liquid coatings that may be applied to the nail. Fixedly and integrally secured through bottom surfaces of either end of the upper ring 16 is a lower resilient encircling ring 18 that enables securement of the manicure shield 10 to an existing finger defines an axis "A" in cooperation with the ring 16, and accordingly accommodates various sizes of fingers. In a raised orientation, the shield 11 is orthogonally oriented relative to axis "A", and is generally parallel to axis "A" in a lowered orientation.

FIG. 6 illustrates an embodiment of the instant invention wherein the former encircling ring 18 is defined by a plurality of arcuate encircling legs 18*a* biased towards each other at their lower terminal ends and spaced apart at the lower terminal ends to define a gap of 0.5 to 2 milimeters to accommodate fingers 15 of various shapes. The interior surface of the legs 18*a* are clad in a cushioned surface layer 20 to enhance comfort in use.

It is understood that the shield may be formed of various lengths and different sizes and is typically utilized in sets to accommodate the fingernails of each hand. As to the manner of usage and operation of the instant invention, the same should be apparent from the above disclosure, and accordingly no further discussion relative the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalent may be resorted to, falling within the scope of the invention.

What is claimed as being new and desired to be protected by Letters Patent of the United States is as follows:

1. A manicure shield comprising, an elongate convex shield, and pivot means formed at a rear portion of the shield to pivotally mount the shield to an upper ring underlying the shield, the upper ring including a lower ring for securement of the shield to an individual's finger, and wherein the convex shield is transparent, and wherein the upper ring is of a relatively rigid first material and the lower ring is formed of a resilient material to enable resilient securement of the manicure shield to the individual's finger, and further including a flexible tab member integrally secured to an upper surface of the upper ring, and the resilient tab in engagement with a rear convex side surface of the shield to maintain the shield in a lowered position, and the flexible tab cooperates with a bottom surface of the shield to maintain the shield in a raised position, and wherein the pivot means includes a plurality of parallel legs integrally secured to rear side edges of the shield and further including a pivot axle directed through each leg wherein each pivot axle is aligned relative to one another and directed orthogonally through the upper ring to pivotally mount the convex shield to the upper ring, and wherein the upper and lower rings are defined by an axis "A" with the convex shield orthogonally oriented to the axis when the shield is in a raised first position, and parallel to axis "A" when the shield is in a lowered second position, and wherein the lower ring is defined by a plurality of encircling legs spaced apart at their lower terminal ends and defined by interior surfaces clad with a cushioned layer.

* * * * *